US005500084A

United States Patent [19]

Hoffman

[11] Patent Number: 5,500,084

[45] Date of Patent: Mar. 19, 1996

[54] METHOD AND APPARATUS FOR PULPING CELLULOSIC MATERIAL USING A VESSEL WITH AN IMPERGNATION ZONE AND AN ATTRITION ZONE

[75] Inventor: Roger P. Hoffman, Green Bay, Wis.

[73] Assignee: Hoffman Environmental Systems, Inc., Green Bay, Wis.

[21] Appl. No.: 310,152

[22] Filed: Sep. 21, 1994

[51] Int. Cl.[6] ..... D21C 3/26

[52] U.S. Cl. ..... 162/17; 162/26; 162/55; 162/57; 162/234; 162/237; 162/245

[58] Field of Search ..... 162/17, 18, 19, 162/26, 55, 233, 234, 237, 243, 245, 250, 57, 251, 59

[56] References Cited

U.S. PATENT DOCUMENTS

| | | | |
|---|---|---|---|
| 2,433,490 | 12/1947 | Stapley et al. | 92/26 |
| 2,847,304 | 8/1958 | Rasch et al. | 92/6 |
| 4,496,426 | 1/1985 | Baumeister et al. | 162/19 |
| 5,034,095 | 7/1991 | Kido et al. | 162/17 |

FOREIGN PATENT DOCUMENTS 553647 3/1958 Canada .

*Primary Examiner*—David L. Lacey
*Assistant Examiner*—Dean T. Nguyen
*Attorney, Agent, or Firm*—Andrus, Sceales, Starke & Sawall

[57] ABSTRACT

A method and apparatus for the continuous production of cellulosic pulp for use in a papermaking process. The apparatus includes a vessel containing a pulping liquor and the vessel consists of a first impregnation zone and a second attrition zone. Wood chips are continuously fed into the upper end of the first zone and are subject to gentle agitation to impregnate the chips with the liquor. The impregnated chips then flow into the second zone where they are heated to a low temperature of 80° to 120° C. and subjected to more severe agitation to break down the chips and liberate the individual fibers. The liquid level in the first zone is higher than in the second zone, causing the liquid to flow upwardly in the second zone with the cooking liquor and the liberated fibers being continuously discharged from the upper end of the second zone, while larger wood chips are retained in the second zone for further attrition. The liberated fibers are removed from the cooking conditions as they are liberated to thereby prevent overcooking and discoloration of the pulp.

18 Claims, 1 Drawing Sheet

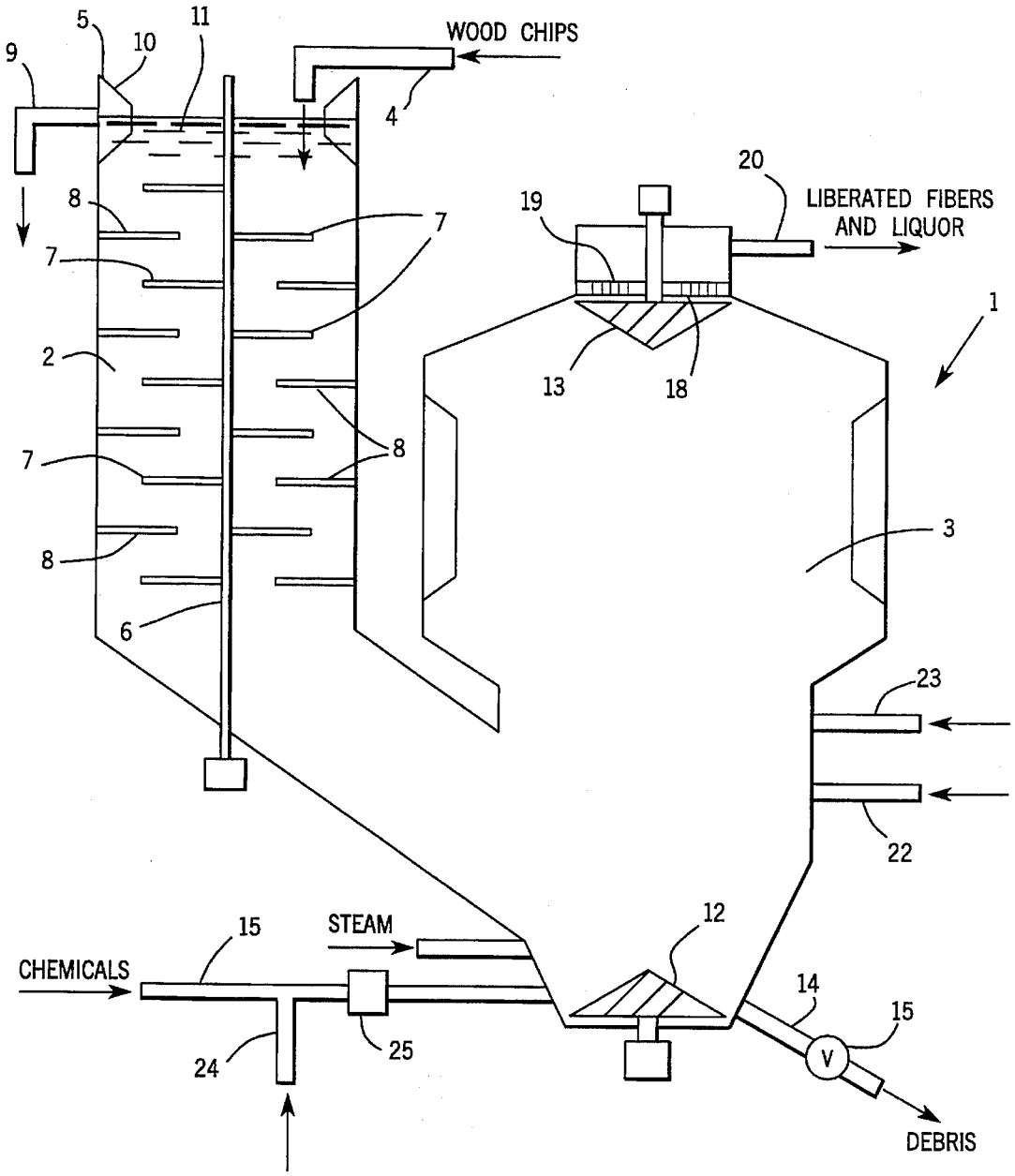
WOOD CHIPS
LIBERATED FIBERS AND LIQUOR
STEAM
CHEMICALS
DEBRIS
V
1
2
3
4
5
6
7
8
9
10
11
12
13
14
15
18
19
20
22
23
24
25

METHOD AND APPARATUS FOR PULPING CELLULOSIC MATERIAL USING A VESSEL WITH AN IMPERGNATION ZONE AND AN ATTRITION ZONE

BACKGROUND OF THE INVENTION

Typical pulping of cellulosic materials, such as wood chips, is accomplished by subjecting the wood chips to very extreme chemical or mechanical conditions to separate the individual fibers so that they may be subsequently recombined to form paper or paperboard.

Conventional chemical pulping involves utilizing chemicals such as NaOH, NaOH and NaHS, $Na_2SO_3$, $CaH_2(SO_3)_2$ or $(NH_4)_2SO_3$. The pulping is carried out either on a batch basis or a continuous basis, and in either case, the wood chips may be presteamed to make them more susceptible to chemical penetration. The chips are then impregnated by pressurization with a solution of the pulping chemicals and water, and heated to a temperature in the range of about 125° to 175° C. The chips are maintained under this temperature and pressure for the appropriate cooking time.

There are a number of variables in the pulping operation, such as the type of wood, the type of chemicals and their concentration, the impregnation pressure, the cooking temperature and the residence time. The objective of chemical pulping is to dissolve the binder, such as lignin and hemicellulose between the fibers the thereby release the individual fibers. A problem arises because the wood chips are not all the same size or density. Thus, the fibers at the outside of the wood chip may be severely overcooked in order to adequately cook and liberate the fibers at the inside of the chip and this problem is accentuated since cellulose is an excellent insulator. The overcooking causes discoloration of the lignin and reduces the yield.

As an alternate to chemical pulping, chemithermal mechanical pulping (CTMP) is used in which the wood chips are subjected to very mild temperature and/or chemical action, and then subjected to very severe mechanical attrition. The mechanical action shears the wood chips into individual pieces, but since the lignin is only softened, the individual pieces are not necessarily fibers, but rather a variety of fibrous debris.

As a result, CTMP pulps have lessor tear strength, tensile strength, and compression strength and stiffness, as compared to chemical pulps. Due to their low strength, the CTMP pulps are commonly used as an additive to Kraft pulp in producing newsprint or magazine grade paper, or for use in making diapers. However, since the temperature conditions are lower than chemical pulping, there is less discoloration of the lignin and the CTMP pulps can be more readily bleached with the use of hydrogen peroxide or oxygen. Typical bleaching of chemical pulps requires chlorine or chlorine derivatives to achieve the required brightness and the use of chlorine compounds causes problems in effluent discharge.

SUMMARY OF THE INVENTION

The invention is directed to a method and apparatus for producing cellulosic pulp that permits individual fibers to be removed from the pulping conditions as they are liberated to thereby produce a higher yield with less discoloration of the pulp.

According to the invention, the pulping vessel is divided into two zones, a first impregnation zone, and a second attrition zone, and contains pulping chemicals which can take the form of alkaline materials, such as sodium hydroxide or potassium hydroxide, or acidic materials such as concentrated acetic acid or nitric acid.

A cellulosic material, such as wood chips, is continuously fed into the open upper end of the impregnation zone, and is subjected to gentle agitation to thereby impregnate the chips with the cooking liquor. The chips flow downwardly through the impregnation zone and are discharged from the lower end of the impregnation zone into the lower end of the attrition zone.

In the attrition zone, the chips are heated to a relatively low temperature in the range of about 80° to 125° C. by the introduction of steam, and are subjected to more severe agitation to thereby break down the wood chips and liberate the fibers.

The liquid level in the impregnation zone is maintained at a higher level than that in the attrition zone, creating a pressure head that acts to move the cooking liquor and wood chips upwardly through the attrition zone.

The liberated fibers are continuously discharged along with spent cooking liquor from the upper end of the attrition zone through an extraction plate, while larger chips are retained in the vessel for further attrition. Thus, the pulping process of the invention removes the individual fibers from the pulping conditions as they are liberated to prevent overcooking and discoloration of the pulp.

Due to the moderate processing conditions and the removal of the fibers as they are liberated, overcooking of the fibers at the outer surface of the wood chips is eliminated which results in a higher yield and less lignin discoloration. As there is less discoloration, the pulp can be more easily bleached to 80 brightness with the use of hydrogen peroxide, oxygen, or ozone and without the use of chlorine derivatives, which produce environmental problems.

As low temperatures and low pressure, less than 1–5 atmospheres, are utilized in the cooking, a strong caustic, such as NaOH or KOH can be used, without the necessity of adding a more moderate inhibiting chemical, such as NaHS, which is normally required under conventional cooking conditions. The use of NaHS results in the formation of by-product gases, such as hydrogen sulfide and mercaptans, which are difficult to contain, thus resulting in mills using NaHS having significant odor problems.

Due to the moderate conditions that are employed, a lesser amount of steam is required in the process.

The process of the invention produces a pulp having a longer fiber length than pulps produced by the CTMP process, so that the strength characteristics of the pulp produced by the process of the invention are comparable to that produced by chemical pulping.

Other objects and advantages will appear during the course of the following description.

DESCRIPTION OF THE DRAWING

The drawing illustrates the best mode presently contemplated of carrying out the invention.

The drawing is a diagrammatic view showing the apparatus of the invention.

DESCRIPTION OF THE ILLUSTRATED EMBODIMENT

The drawing illustrates diagrammatically the apparatus for carrying out the pulping method of the invention. The apparatus comprises a pulping vessel 1, which contains a cooking liquor that preferably is an aqueous solution of an alkali metal hydroxide, such as sodium hydroxide or potassium hydroxide. Alternately, an acidic material, such as concentrated acetic acid or nitric acid can be used in place of the alkali metal hydroxide.

Vessel 1 is composed of an impregnation zone or chamber 2, and an attrition zone or chamber 3. The lower end of impregnation chamber 2 communicates with the lower end of the attrition chamber 3.

A cellulosic material, such as wood chips, is continuously fed through feed line 4 into the open upper end 5 of the impregnation zone 2. The mixture of wood chips and cooking liquor in chamber 2 is subjected to mild low speed agitation through operation of agitator 6, which is mounted centrally of the chamber. Agitator 6 includes a plurality of agitator blades or paddles 7, while the inner wall of the impregnation zone 2 has a series of stationary baffles 8, which cooperate with the agitator paddle blades 7 to provide gentle agitation for the cooking liquor and wood chips in chamber 2, thus impregnating the chips with the cooking liquor.

An overflow outlet pipe 9 is connected to the upper end of impregnation chamber 2, and an annular screen 10 is mounted on the inner wall of chamber 2 and extends across the overflow outlet 9. The screen 10 is sized such that fines released from the wood chips in chamber 2 during the agitation will be discharged through the overflow outlet 9, while the wood chips will be retained in the chamber. The overflow outlet 9 determines the liquid level in the chamber 2 which is indicated by 11.

The cooking liquor and wood chips flow from the lower end of the impregnation chamber 2 into the lower end of the attrition chamber 3. In the attrition chamber 3 the cooking mixture, consisting of the cooking liquor and wood chips, is subjected to moderate agitation through operation of a pair of power operated agitators 12 and 13. Agitator 12 is mounted at the lower end of the attrition chamber 3, while agitator 13 is mounted in the upper end of the chamber.

Heavy debris. such as sand, stones, and the like can be removed from the attrition chamber 3 through the outlet line 14, and flow through line 14 can be controlled by valve 15.

Pulping chemicals, such as sodium or potassium hydroxide, can be continuously added to the attrition chamber 3 through line 15 which is connected to the lower end of the chamber.

The temperature of the cooking liquor in attrition chamber 3 is maintained at a relatively low value in the range of about 80° to 125° C. by the introduction of steam into the attrition chamber through line 17. This cooking temperature is considerably below the cooking temperature of a typical chemical pulping process that normally has a temperature of about 150° C.

As the liquid level 11 in the impregnation chamber 2 is substantially above the upper end of the attrition chamber 3, a pressure head is created which will cause continuous upward flow of the cooking liquor and wood chips in the attrition chamber 3.

Under the processing conditions in the attrition chamber 3, the chemicals will soften and dissolve the binders, such as lignin and hemicellulose, in the wood chips, thereby releasing the individual fibers. In accordance with the invention, the liberated fibers are removed from the cooking conditions in attrition chamber 3 as they are released. In this regard, the upper end of the attrition chamber 3 is provided with an outlet 18, and the outlet is enclosed by an extraction plate 19 having holes or perforations of a predetermined size. The extraction plate 19 is sized such that the released fibers will pass through the plate to the outlet line 20 while the wood chips will be retained in the attrition chamber. The fibers and spent liquor being discharged through the outlet line 20 can then be subjected to conventional processing, such as screening, pulp cleaning, pulp washing, and bleaching prior to being fed to the papermaking machine.

It is contemplated that additional make up water can be supplied to vessel 1 if necessary to provide the desired water balance in the vessel.

During the processing of the pulp discharged from the attrition chamber 3 through line 20, larger fibers or fragments may be separated from the pulp and can be returned to the attrition chamber 3 through line 22. In addition, the overflow cooking liquor and fines being discharged through outlet 9 in impregnation chamber 2 can be recycled and introduced into the attrition chamber 3 through line 23. Further, wash water from the pulp thickening operation which occurs just prior to bleaching the pulp can be fed into line 24 and combined with the chemical makeup in line 15, and the two streams can be mixed by passing through a suitable mixer 25 before being fed into chamber 3.

While the drawing shows a pair of agitators 12 and 13 being employed in the attrition chamber 3, it is contemplated that a single agitator which extends substantially the full height of the attrition chamber can be employed.

With the process of the invention, the individual fibers as they are liberated from the wood chips, are discharged from the attrition chamber or zone 3, thus preventing overcooking of the liberated fibers. The process thus results in more uniform cooking and less lignin discoloration. As the pulp has less discoloration, the pulp can be more easily bleached to an 80 brightness with the use of hydrogen peroxide, oxygen, or ozone and without the use of chlorine derivatives.

The invention also results in a higher yield, as overcooking of liberated fibers does not occur.

Due to the use of lower processing temperatures, a lesser amount of steam is required than with a typical chemical pulping process.

As the process of the invention is carried out at substantially lower temperatures and pressures than a conventional chemical pulping process, more aggressive alkaline materials, such as sodium and potassium hydroxide, can be used without the need for more expensive inhibitors, such as sodium hydrosulfide, which are commonly required in chemical pulping processes and result in the formation of hydrogen sulfide and mercaptans. These byproduct gases are difficult to contain and result in mills using these chemicals having significant odor problems.

Various modes of carrying out the invention are contemplated as being within the scope of the following claims particularly pointing out and distinctly claiming the subject matter which is regarded as the invention.

I claim:

1. A method of producing a cellulosic pulp, comprising the steps of impregnating cellulosic particles containing binders and fibers with a cooking liquor to provide a mixture, continuously flowing the mixture through a cooking zone, maintaining the temperature of the mixture in said cooking zone below 125° C. and at a value sufficient to dissolve the binders in said particles and agitating the mixture to liberate cellulosic fibers from said particles, and continuously discharging said liberated fibers and said cooking liquor from said cooking zone while preventing discharge of said particles from said cooking zone to produce said cellulosic pulp.

2. The method of claim 1, and including the step of maintaining the pressure in said cooking zone at a value of less than 1.5 atmospheres.

3. The method of claim 1 wherein the step of preventing the discharge of said particles from said cooking zone comprises passing the liberated fibers and said liquor through a screen having a size sufficient to prevent passage of said particles.

4. The method of claim 1, wherein the temperature in said cooking zone is maintained at a value of 80° C. to 125° C.

5. A method of producing a cellulosic pulp, comprising the steps of continuously introducing particles of a cellulosic material containing binders and fibers into a first zone of a pulping vessel containing a cooking liquor to form a mixture, impregnating said particles with said liquor in said first zone, continuously discharging said mixture from the lower end of said first zone to a second zone of said vessel, heating the mixture in said second zone to a temperature below 125° C. and at a value sufficient to dissolve the binders in said particles and agitating the mixture in said second zone to thereby liberate individual fibers from said particles, and continuously flowing said liquor and said liberated fibers through a screen at the upper end of said second zone to thereby discharge said liberated fibers and said liquor from said second zone while maintaining said particles in said second zone to provide said cellulosic pulp.

6. The method of claim 5, and including the step of maintaining the liquid level in said first zone above the liquid level in said second zone to thereby create a pressure head to cause an upward flow of said cooking liquor in said second zone.

7. The method of claim 6, and including the step of maintaining the pressure in said first and second zones at a value of less than 1.5 atmospheres.

8. The method of claim 5, and including the step of overflowing said cooking liquor from the upper end of said first zone.

9. The method of claim 8, and including the step of screening the liquor overflowing from said first zone to prevent discharge of said cellulosic particles.

10. The method of claim 5, wherein the step of heating the mixture comprises introducing steam into said second zone.

11. The method of claim 5, and including the step of agitating the mixture in said first zone to aid in impregnating said particles with said liquor.

12. The method of claim 11, wherein the speed of agitation in said second zone is greater than the speed of agitation in said first zone.

13. The method of claim 5, wherein said cooking liquor includes cooking chemicals and said method includes the step of continuously introducing cooking chemicals into said second zone.

14. The method of claim 5, wherein the temperature in the second zone is maintained at a value in the range of 80° C. to 125° C.

15. An apparatus for the continuous production of cellulosic pulp, comprising a pulping vessel including a first chamber and a second chamber, a lower end of said first chamber communicating with said second chamber, a cooking liquor contained in said first and second chambers, said cooking liquor containing cooking chemicals, the upper end of said first chamber being open to the atmosphere, feeding means for continuously feeding wood chips containing binders and fibers into the open upper end of said first chamber, said wood chips being impregnated with said liquor in said first chamber to form a mixture, said mixture of wood chips and liquor being discharged from said first chamber to said second chamber, heating means for heating the mixture in said second chamber to thereby cause the chemicals to dissolve the wood chip binder, agitating means in said second chamber for agitating said mixture to liberate individual fibers from said chips, means for flowing the mixture upwardly in said second chamber, outlet means in the upper end of said second chamber, and a screen disposed across the outlet means, said screen having a size to permit flow of the liberated fibers through said screen while preventing flow of said wood chips through said screen.

16. The apparatus of claim 15, and including agitating means in said first chamber for agitating said mixture.

17. The apparatus of claim 15, wherein said heating means comprises means for introducing steam into said second chamber.

18. The apparatus of claim 15, wherein the level of said liquid in said first chamber is higher than the level of liquid in said second chamber to thereby create a pressure head, said pressure head constituting said means for flowing the mixture upwardly in said second chamber.

* * * * *